United States Patent [19]

Gladd et al.

[11] Patent Number: 4,722,691

[45] Date of Patent: Feb. 2, 1988

[54] HEADER ASSEMBLY FOR A PRINTED CIRCUIT BOARD

[75] Inventors: Joseph H. Gladd; Ronald A. Baldwin, both of Cortland; James D. Daugherty, Brookfield, all of Ohio

[73] Assignee: General Motors Corporation, Detroit, Mich.

[21] Appl. No.: 825,352

[22] Filed: Feb. 3, 1986

[51] Int. Cl.[4] ..... H01R 9/09

[52] U.S. Cl. ..... 439/79; 439/76

[58] Field of Search ..... 339/17 R, 17 C, 17 LC, 339/17 LM, 17 L, 59 R, 59 M, 61 R, 61 M, 176 MP

[56] References Cited

U.S. PATENT DOCUMENTS

| | | | |
|---|---|---|---|
| 3,493,916 | 2/1970 | Hansen | 339/17 LC |
| 3,836,935 | 9/1974 | Johnson | 339/17 LM |
| 4,054,345 | 10/1977 | Sherwood | 339/17 M |
| 4,056,300 | 11/1977 | Schumacher | 339/103 R |
| 4,176,895 | 12/1979 | Aldridge | 339/17 CF |
| 4,188,085 | 2/1980 | Aldridge et al. | 339/176 MP |
| 4,341,433 | 7/1982 | Cherian et al. | 339/176 MP |
| 4,354,718 | 10/1982 | Bright et al. | 339/17 CF |
| 4,433,886 | 2/1984 | Cassarly et al. | 339/14 R |
| 4,473,266 | 9/1984 | Soltysik et al. | 339/75 M |
| 4,483,581 | 11/1984 | Kourimsky | 339/176 MP |
| 4,491,376 | 1/1985 | Gladd et al. | 339/17 LC |
| 4,514,023 | 4/1985 | Rice | 339/17 CF |
| 4,515,425 | 5/1985 | Nakano | 339/75 MP |

FOREIGN PATENT DOCUMENTS 2095485 9/1982 United Kingdom .

*Primary Examiner*—Neil Abrams
*Attorney, Agent, or Firm*—Patrick M. Griffin

[57] ABSTRACT

An improved header assembly includes means providing for improved conductor pin flexibility to accommodate forced shifting caused by support manufacturing tolerance variations or by differentials in rates of thermal expansion. A comb member is formed of a flexible material having a sufficient rigidity to retain the conductor pins in the proper position to be joined by solder joints to an array of holes in a circuit board, but is sufficiently elastic to allow the pins to shift later so as to not jeopardize the solder joints.

3 Claims, 4 Drawing Figures

HEADER ASSEMBLY FOR A PRINTED CIRCUIT BOARD

This application relates to header assemblies and specifically to an improved header assembly that includes means providing for conductor pin improved flexibility.

BACKGROUND OF THE INVENTION

Header assemblies are often used to make multiple electrical connections from a printed circuit board to another component. Such header assemblies generally include a housing of dielectric material and a plurality of metal conductor pins. The conductor pins have a first portion that is firmly held in the housing and a second portion extending from the housing, often with a 90° bend between the first and second portions of the pins. Generally, the pins are arranged in one or more rows. Some means is desirable to maintain these pin second portions of the pins in a pattern so that they may be directed into an array of holes in the circuit board. However, variations may occur in the relative location of the circuit board and other components that may forcibly shift the first portions of the pins relative to the second portions. This may occur because of manufacturing tolerance variations in the supports to which the circuit board and the components are initially attached during assembly. Such a forcible shifting may also occur later due to differentials in the rates of thermal expansion of the various components. The forcible shifting may jeopardize the solder joints in the absence of some means to accommodate it.

Header assemblies of the general type referred to are known in the art. The U.S. Pat. No. 4,054,345 to Sherwood discloses a connector assembly that uses two headers to connect a plurality of 90° pins between a master circuit board and a plurality of other circuit boards arranged normal thereto. The first header firmly holds a first portion of the pins. The second header sits on the master circuit board over a plurality of circuit board holes and has a plurality of tapered, oversized passages that direct the second portions of the pins into the holes in the master board. This connector assembly has a disadvantage of being a two piece assembly, because the first and second headers are structurally separate and do not stay together as a unit. In addition, any flexibility of the first portions of the pins relative to the second portions would be limited by how far oversized the tapered passages in the second header were relative to the pin second portions. The U.S. Pat. No. 4,491,376 to Gladd et al, assigned to the assignee of the present invention, discloses a one-piece header assembly. The header assembly there disclosed includes a plurality of 90° pins, each of which has a first portion held firmly in a dielectric housing and a second portion is maintained in proper position by a slotted locator plate integral with the housing. Any flexibility of the second portions of the pins relative to the first portions is likewise limited by the amount of oversizing of the slots in the locator plate relative to the pin second portions. While this one-piece header assembly works well in most environments, there may be environments where greater possible variations of the type discussed above exist, and where additional flexibility is needed.

SUMMARY OF THE INVENTION

The subject invention provides an improved header assembly which includes means providing for such improved flexibility of the conductor pins. The same means that provides for improved flexibility also cooperatively provides additional advantages, as well.

The improved header assembly of the invention includes a housing, a plurality of conductor pins, and a comb member, which together form a unitary assembly and which cooperate together to provide improved flexibility to the conductor pins.

The conductor pins are formed of metal and have a first portion that is firmly held in the housing and a second portion that extends from the housing to be joined by solder joints into a predetermined array of holes in a circuit board. The housing is adapted to be attached, after the solder joints are formed, to a first support, such as a slot in the case of a radio chassis. The circuit board is adapted to be attached to second support, such as a bracket inside the case of the radio chassis. Manufacturing tolerance variations may cause the relative location of these first and second supports to vary, which can in turn cause a forcible relative shifting of the first and second pin portions as housing and circuit board are so attached. In addition, different rates of thermal expansion of the components of the header assembly, as well as of those structures to which they are attached, may cause a similar forcible relative shifting. This creates the need for a greater flexibility between the first and second portions of the conductor pins so as not to jeopardize the solder joints.

The subject invention provides a means to give the necessary improved flexibility. The conductor pins include a loop portion of a generally S or C shape between their first and second portions. In the preferred embodiment, the pins are arranged so that the second portions are disposed in a pair of parallel rows. These loop portions provide an enhanced flexibility between the first and second portions of the pins, compared to a 90° bend. A comb member includes a predetermined array of passages therethrough that are sized to fit tightly over the rows of pin second portions. This tight fit keeps the housing, the pins, and comb member together as a easily handled, unitary assembly. The comb member is formed from a material different from the material of the housing. The comb member material has a sufficient rigidity to retain the rows of pin second portions in a pattern that substantially matches the array of holes in the circuit board. Therefore, the pin second portions will be properly directed into the circuit board hole prior to forming the solder joints. However, the material of the comb member also has sufficient elasticity to allow the pin second portions, in cooperation with the loop portions, to shift relative to the pin first portions. Therefore, should the possible types of forcible relative shifting referred to above occur, the elasticity of the comb member allows the pin first and second portions to be so relatively shifted without straining or jeopardizing the solder joints. The enhanced flexibility allowed by the loop portions is therefore not gained at the expense of maintaining the pin second portions in the proper position for insertion into the holes in the circuit board.

In addition, the embodiment disclosed provides additional advantages. The comb member also includes a pair of substantially parallel support rails located to either side of the array of passages in the comb member.

The support rails engage the circuit board and limit how far the pin second portions are inserted into the holes in the circuit board. This is important to properly assembly and to the proper formation of the solder joints. Since the comb member is made of an elastomer material, these support rails may conform to the surface of the circuit board and thereby provide a channel, in cooperation with the circuit board, to allow the area of the circuit board between the support rails to be flushed and cleaned. In addition, the support rails serve to space a central portion of the comb member away from the circuit board. Since the parallel rows of pin second portions are themselves spaced apart, this has the effect of creating a usable space or volume between the comb and the circuit board and between the rows of pin second portions. This space may be occupied by other components on the circuit board, besides providing a flushing channel.

It is, therefore, a broad object of the invention to provide an improved header assembly of the type that retains a plurality of conductor pins, and in which each of the pins has a first portion held in a housing and a second portion extending from the housing so as to be joined by solder joints into a predetermined array of holes in a circuit board or the like, and in which the housing further is adapted to be attached to a first support, with the circuit board further being adapted to be attached to a second support after the solder joints have been formed, an improved header assembly that includes a novel means to provide flexibility of the pins so as to accommodate initial tolerance variations in the relative location of the first and second supports as the housing and the circuit board are so attached as well as later variations in thermal expansions of the housing, supports, circuit board and pins.

It is another object of the invention to provide such a means that includes a loop portion at the transition between the first and second portion of the pins, the loop portion providing enhanced flexibility between the first and second portions of the pins, and a comb member that includes a predetermined array of passages sized to fit tightly over the second portions of the pins so as to form a unitary assembly with the housing and the pins, the comb member further being formed of a material that has sufficient rigidity to retain the pin second portions in a pattern substantially matching the array of circuit board holes so as to direct the pin second portions into the circuit board holes prior to the solder joints being formed, the comb member material further having sufficient elasticity to allow the pin second portions, in cooperation with the pin loop portions, to shift relative to the pin first portions when the housing is attached to the first support and the circuit board is attached to the second support, as well as when the housing, supports, circuit board and pins differentially expand, thereby accommodating the variations without jeopardizing the solder joints.

It is yet another object of the invention to provide an improved header assembly of the type described in which the comb member also has a pair of substantially parallel support rails located to either side of the array of passages and engageable with the circuit board to limit the protrusion of the pin second portions through the circuit board holes, with the elasticity of the support rails allowing them to conform to the circuit board, thereby also providing a channel in cooperation with the circuit board for flushing the area between the support rails.

It is still another object of the invention to provide an improved header assembly of the type described in which the pin second portions are arranged in a pair of substantially parallel rows and in which the comb member includes a central portion with the predetermined array of passages therethrough, with the support rails holding the comb central portion away from the circuit board so as to create a usable space between the rows of pin second portions, and with the support rails thereby also providing a channel in cooperation with the circuit board and the comb central portion for flushing the area of the circuit board between the support rails.

BRIEF DESCRIPTION OF THE DRAWINGS

These and other objects and features of the invention will appear from the following written description and drawings in which.

DESCRIPTION OF THE PREFERRED EMBODIMENT

Figure 1:
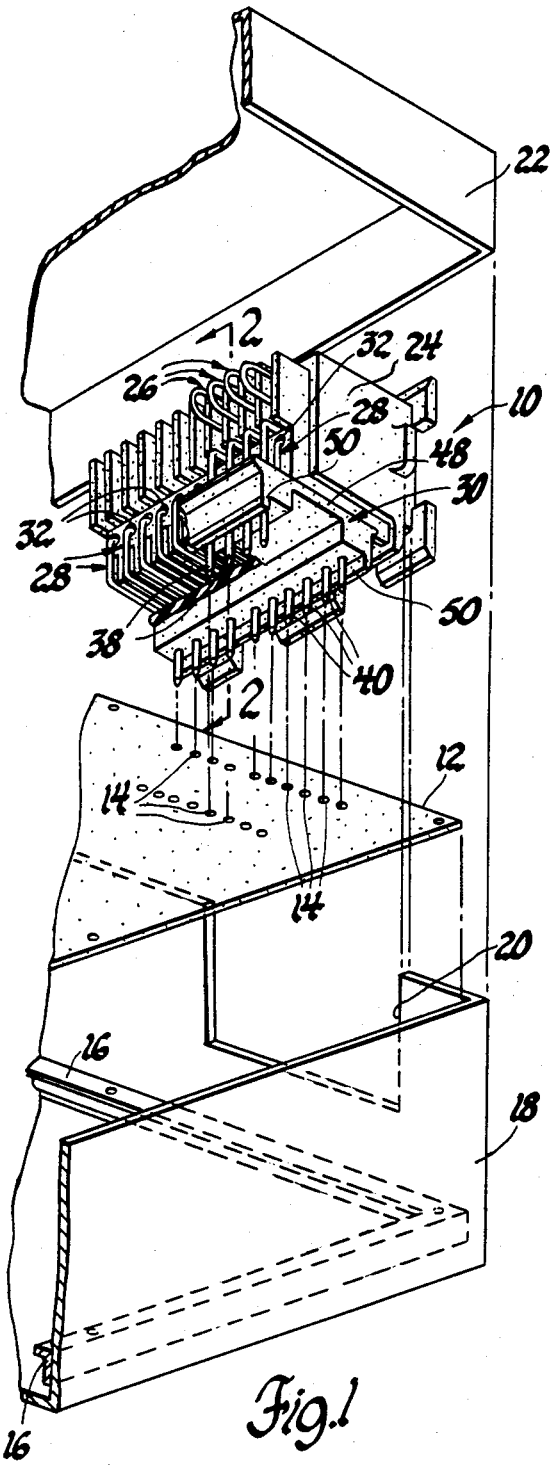
FIG. 1 is a perspective view showing the header assembly of the invention in exploded relation to a portion of a circuit board and a portion of a radio chassis case and cover, with a portion of the comb member broken away.

Referring first to FIG. 1, the improved header assembly of the invention is designated generally at 10. Header assembly 10 makes electrical connection with a circuit board 12, which has a predetermined array of holes 14 therein. Circuit board 12 is then attached to a first support provided by a bracket 16 in the metal case of a radio chassis, designated generally at 18. Header assembly 10 is adapted to be attached to second support provided by a slot 20 cut into metal case 18. A cover 22 is fitted over metal case 18. The details of header assembly 10 and its joining to circuit board 12 will be described below.

Figure 2:
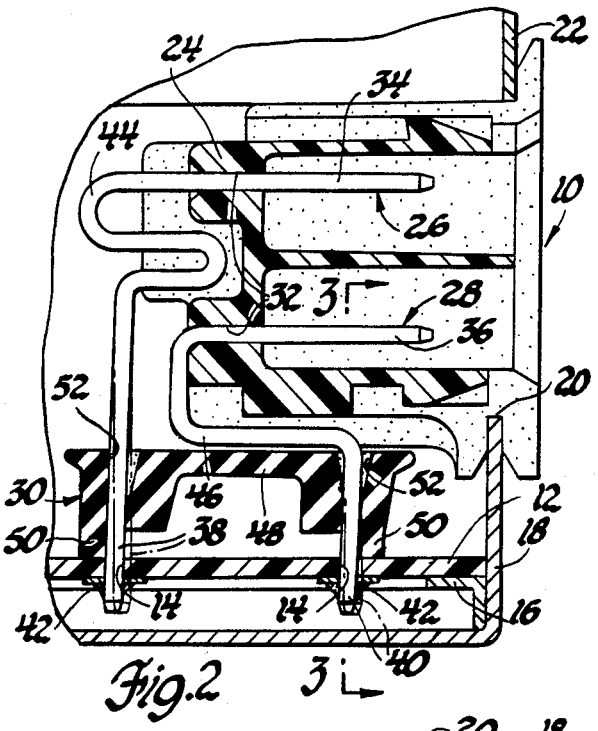
FIG. 2 is a sectional view taken along the line 2—2 of FIG. 1 showing the header assembly of the invention and circuit board after formation of the solder joints.

Referring next to FIGS. 1 and 2, header assembly 10 includes a housing 24, a plurality of conductor pins designated generally at 26 and 28, and a comb member designated generally at 30. Housing 24 is molded of a dielectric material such as plastic, and a male connector, not illustrated, would be plugged onto pins 26 and 28. Housing 24 also includes a pair of rows of generally horizontally extending pin openings 32. Each pin 26 and 28 has a generally horizontal first portion, 34 and 36 respectively, which is firmly fitted within one of the pin openings 32. Each pin 26 and 28 also includes a generally vertically extending second portion 38 and 40 respectively that extends from housing 24, residing in two substantially parallel rows. The rows of pin second portions 38 and 40 are to be joined by solder joints 42 to circuit board holes 14 in conventional fashion. More detail about the formation of solder joints 42 will be given below. Each pin 26 and 28 includes a loop portion 44 and 46 respectively located at the transition between the respective first and second portions 34, 38 and 36, 40. Loop portions 44 and 46 provide an enhanced flexibility as compared to a 90 degree pin. Loop portion 44 is S-shaped, while loop portion 46 is C-shaped, although that could be reversed, or all the loop portions could be either S or C shaped, if desired. However, the particular configurations shown, with the C-shaped loop portions 46 being nested beneath the S-shaped loop portions 44 and located between the parallel rows of pin second portion 38 and 40, is advantageously compact. It will be appreciated that without some means of control, the parallel rows of pin second portions 38 and 40, because of the enhanced flexibility proved by the loop portions 44 and 46, could wander excessively, making insertion into the circuit board holes 14 difficult. The subject invention provides a means of control, while maintaining the enhanced flexibility, as will be described below.

Figure 3:
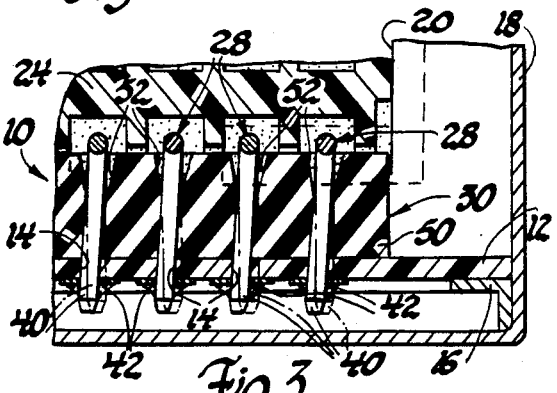
FIG. 3 is a sectional view taken along the line 3—3 of FIG. 2.

Referring next to FIGS. 1–3, the comb member 30 is formed of a material different from housing 24, being silicone rubber or other elastic material in the preferred embodiment. Comb member 30 includes a central portion 48 and a pair of parallel support rails 50. Central portion 48 includes an array of passages 52 therethrough in a pattern that substantially matches the pattern of circuit board holes 14. Passages 52 are generally tapered from top to bottom, so as to guide the pin second portion 38 and 40 thereinto when the comb member 30 is added to assembly 10. However, the passages 52 at their smallest point are sized to be small enough to fit tightly on the pin second portion 38 and 40. The tightness of this fit assures that the comb member 30 will be held to the pin second portions 38 and 40, thus forming a unitary assembly with the pins 26 and 28 and the housing 24. The tightness of that fit also, as a practical matter, assures that the movement of comb member 30 on to the pin second potions 38 and 40 will stop before the central portion 48 contacts the loop portion 46 of the pins 28.

Referring now to FIGS. 1–2, once the header assembly 10 has been completed by attaching the comb member 30, the pin second portions 38 and 40 may be inserted into the circuit board holes 14. FIG. 1 shows the path of that insertion in dotted lines. While comb member 30 is elastic, it is still sufficiently rigid to maintain the pin second portions 38 and 40 in the proper position for insertion. In addition, the support rails 50 will engage circuit board 12, as may be seen in FIG. 2, to limit the amount of the protrusion of the pin second portions 38 and 40 through the circuit board 12 as they are so inserted. The support rails 50 will maintain the amount of that protrusion within an acceptable range for the proper formation of the solder joints 42. As is well known in the art, solder joints are generally formed by a process in which flux is first applied, and solder later applied, as by a dipping bath. As a final step, the solder joints are flushed to remove excess flux and other debris. The support rails 50, by virtue their elasticity, may easily conform to the surface of the circuit board 12, thereby forming a convenient channel for flushing the area of circuit board 12 between the support rails 50. That area of the circuit board 12 may contain flux or other debris acquired during the assembly process. For the particular embodiment disclosed, that channel is an enclosed one cooperatively formed by the bridging central portion 48, the support rails 50, and the circuit board 12. In addition, since the pin second portions 38 and 40 are spaced apart, and since the support rails 50 space the comb member central portion 48 away from the circuit board 12, a usable space or volume is effectively created where other circuit board components could be located, although none are illustrated. The comb central portion 48 also conveniently shields the C-shaped loop portions 46 of conductor pins 28 away from that usable space.

Figure 4:
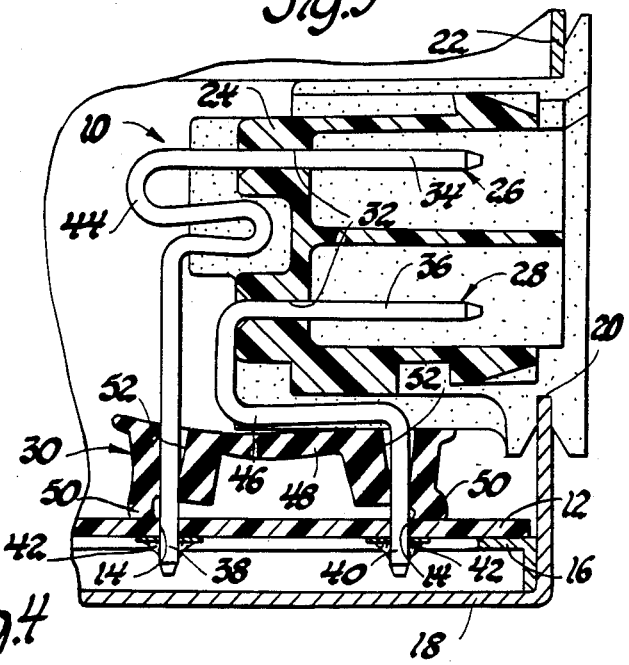
FIG. 4 is a view similar to FIG. 2, but showing the relation of the pins and comb member after flexing of the pins has occurred.

Referring now to FIGS. 2–4, the flexing of the pins 26 and 28 is illustrated. Several conditions may create a need for pin flexibility. The relative positions of slot 20 and bracket 16 may vary due to tolerances in the manufacture of the metal case 18. Thus, as housing 24 and circuit board 12 are attached to slot 20 and bracket 16, a force tending to shift the pin second portions 38 and 40 from their ideal positions may be applied. Were the pin second portions 38 and 40 rigidly held, there could be a resultant stressing of the solder joints 42, with a possible breaking or cracking thereof. However, the comb member 30 has sufficient elasticity to allow the pin second portions 38 and 40 to shift in any direction that they might be forced by the type of tolerance variation just discussed. Other conditions that might lead to the necessity of such flexibility would be differences in the rate of thermal expansion of the pins 26 and 28, the housing 24, the circuit board 12, and the metal case 18, all of which are formed from different materials. Different rates of thermal expansion could cause the pin second portions 38 and 40 to be forcibly shifted, with similar consequences. This type of shifting is also accommodated by the invention. FIGS. 2 and 3 illustrate, in dotted lines, possible shifting in two different directions. FIG. 4 illustrates, in an exaggerated fashion, a shifting of the pins 26 and 28 during which their respective loop portions 44 and 46 have been compressed upwardly, and and during which the comb member central portion 48 has been bowed and the support rails 50 have been compressed. Although this represents an exaggerated case, it illustrates well the great flexibility allowed by the invention. It will also be noted that the support rails 50, due to their elasticity, have remained in good conformation with the circuit board 12.

Variations of the preferred embodiment are possible. The support rails are not necessary, in the broadest sense, to retain the pins in their proper location or to allow for the enhanced pin flexibility. However, they do work in cooperation with the basic structure of the invention to provide the additional advantages of spacing and channel forming, as described. Only one row of pins could be used, or the pins could be arrayed in a pattern other than a row. The two row pin pattern is practical and compact, however. With such a pattern, the comb member central portion conveniently serves both to keep the two rows in alignment, as well as cooperating to shield the loop portions of one rows, and to form a closed channel. Therefore, it will be understood that the invention is capable of being embodied in structures other than that disclosed, and is not intended to be so limited.

The embodiments of the invention in which an exclusive property or privilege is claimed are defined as follows:

1. In an improved header assembly of the type that retains a plurality of conductor pins, with each of said pins having a first portion held in a housing of said header assembly and a second portion extending from said housing so as to be joined by solder joints into a predetermined array of holes in a circuit board or the like, said housing further being adapted to be attached to a first support, and said circuit board further being adapted to be attached to a second support, after said solder joints have been formed, the improvement including means providing for improved flexibility of said pins so as to accommodate initial tolerance variations in the relative location of said first and second supports as said housing and said circuit board are so attached as well as later variations in thermal expansions of said housing, supports, circuit board and pins, comprising, a loop portion at the transition between the first and second portion of said pins, said loop portion providing enhanced flexibility between the first and second portions of said pins, a comb member formed of a different, more elastic material than said housing and having a predetermined array of passages therethrough sized to fit tightly over the second portions of said pins so as to form a unitary assembly with said housing and said pins, said comb member material having sufficient rigidity to retain said pin second portions in a pattern substantially matching the array of circuit board holes so as to direct said pin second portions into said circuit board holes prior to said solder joints being formed, said comb member material being sufficiently elastic to allow said pin second portions, in cooperation with said pins loop portions, to shift relative to said pin first portions when said housing is attached to said first support and said circuit board is attached to said second support, as well as when said housing, supports, circuit board and pins differentially expand, thereby accommodating said variations without jeopardizing said solder joints.

2. In an improved header assembly of the type that retains a plurality of conductor pins, with each of said pins having a first portion held in a housing of said header assembly and a second portion extending from said housing so as to be joined by solder joints into a predetermined array of holes in a circuit board or the like, said housing further being adapted to be attached to a first support, and said circuit board further being adapted to be attached to a second support, after said solder joints have been formed, the improvement including means providing for improved flexibility of said pins so as to accommodate initial tolerance variations in the relative location of said first and second supports as said housing and said circuit board are so attached as well as later variations in thermal expansions of said housing, supports, circuit board and pins comprising, a loop portion at the transition between the first and second portion of said pins, said loop portion providing enhanced flexibility between the first and second portions of said pins, a comb member formed of a different, more elastic material than said housing and having a predetermined array of passages therethrough sized to fit tightly over the second portions of said pins so as to form a unitary assembly with said housing and said pins, said comb member material having sufficient rigidity to retain said pin second portions in a pattern substantially matching the array of circuit board holes so as to direct said pin second portions into said circuit board holes prior to said solder joints being formed, said comb member material being sufficiently elastic to allow said pin second portions, in cooperation with said pin loop portions, to shift relative to said pin first portion when said housing is attached to said first support and said circuit board is attached to said second support, as well as when said housing, supports, circuit board and pins differentially expand, thereby accomodating said variations without jeopardizing said solder joints, said comb member also having a pair of substantially parallel support rails located to either side of said array of passages and engageable with said circuit board to limit the protrusion of said pin second portions through said circuit board holes, said support rails, by virtue of being elastic, being conformable to said circuit board, thereby also providing a channel in cooperation with said circuit board for flushing the area of said circuit board between said support rails.

3. In an improved header assembly of the type that retains a plurality of conductor pins, with each of said pins having a first portion held in a housing of said header assembly and a second portion extending from said housing and arranged in a pair of substantially parallel rows so as to be joined by solder joints into a predetermined array of holes in a circuit board or the like, said housing further being adapted to be attached to a first support, and said circuit board further being adapted to be attached to a second support, after said solder joints have been formed, the improvement including means providing for improved flexibility of said pins so as to accomodate initial tolerance variations in the relative location of said first and second supports as said housing and said circuit board are so attached as well as later variations in thermal expansions of said housing, supports, circuit board and pins, comprising;

a loop portion at the transition between the first and second portion of said pins, said loop portion providing enhanced flexibility between the first and second portions of said pins, a comb member formed of a different, more elastic material than said housing and having a central portion with predetermined array of passages therethrough sized to fit tightly over the second portions of said pins so as to form a unitary assembly with said housing and said pins and substantially cover the loop portions of said portion of conductor pin, said comb member material having sufficient rigidity to retain said pin second portions in a pattern substantially matching the array of circuit board holes so as to direct said pin second portions into said circuit board holes prior to said solder joints being formed, said comb member material being sufficiently elastic to allow said pin second portions, in cooperation with said pin loop portions, to shift relative to said pin first portions when said housing is attached to said first support and said circuit board is attached to said second support, as well as when said housing, supports, circuit board and pins differentially expand, thereby accommodating said variations without jeopardizing said solder joints, said comb member also having a pair of substantially parallel support rails located to either side of said array of passages and engageable with said circuit board to limit the protrusion of said pin second pin second portions through said circuit board holes and to hold said comb central portion away from said circuit board so as to create usable space between said rows of pin second portions, said support rails, by virtue of being elastic, being conformable to said circuit, thereby also providing a channel in cooperation with said circuit board and said comb central portion for flushing the area of said circuit board between said support rails.

* * * * *